US012420892B2

(12) United States Patent
Hunter

(10) Patent No.: US 12,420,892 B2
(45) Date of Patent: Sep. 23, 2025

(54) BOAT ANCHOR ROLLER

(71) Applicant: Grady-White Boats, Inc., Greenville, NC (US)

(72) Inventor: Joe Hunter, Kinston, NC (US)

(73) Assignee: Grady-White Boats, Inc., Greenville, NC (US)

( * ) Notice: Subject to any disclaimer, the term of this patent is extended or adjusted under 35 U.S.C. 154(b) by 698 days.

(21) Appl. No.: 17/736,710

(22) Filed: May 4, 2022

(65) Prior Publication Data

US 2023/0356805 A1 Nov. 9, 2023

(51) Int. Cl.
*B63B 21/22* (2006.01)
*B63B 21/04* (2006.01)

(52) U.S. Cl.
CPC ..... *B63B 21/22* (2013.01); *B63B 21/04* (2013.01)

(58) Field of Classification Search
CPC ..... B63B 21/00; B63B 21/04; B63B 21/22
USPC ..... 114/210
See application file for complete search history.

(56) References Cited

U.S. PATENT DOCUMENTS

| | | | | |
|---|---|---|---|---|
| 2,554,804 | A | | 5/1951 | Amundson |
| 2,837,050 | A | | 6/1958 | Frank |
| 3,082,730 | A | | 3/1963 | Good |
| D259,240 | S | | 5/1981 | Myron |
| 4,362,119 | A | | 12/1982 | Thimander |
| 4,556,007 | A | | 12/1985 | Awalt, Jr. |
| D323,483 | S | | 1/1992 | Patten |
| 5,205,234 | A | | 4/1993 | Schoell |
| 5,996,524 | A | | 12/1999 | Johnson |
| 7,299,759 | B2 | | 11/2007 | Francis |
| 7,484,469 | B2 | | 2/2009 | Francis |
| D591,141 | S | | 4/2009 | Miller |
| D862,356 | S | * | 10/2019 | Ceccarelli ..... D12/215 |

FOREIGN PATENT DOCUMENTS

EP 1466825 A1 * 10/2004 ..... B63B 21/04

* cited by examiner

*Primary Examiner* — Lars A Olson
(74) *Attorney, Agent, or Firm* — Olive & Olive, P.A.

(57) ABSTRACT

An anchor roller incudes side walls to allow an anchor to be stored therein. Openings are provided in the side walls to allow the anchor line to pass there through to allow tying to a cleat.

9 Claims, 10 Drawing Sheets

BOAT ANCHOR ROLLER

CROSS-REFERENCE TO RELATED APPLICATIONS

This application is a continuation of application Ser. No. 29/837,332, the entire content of which is hereby incorporated herein by reference in its entirety.

FIELD OF THE INVENTION

This invention relates to anchor rollers of the type found on the bow of a boat which relatively immovably secure an anchor while a boat is underway, and allow an anchor to be easily deployed when the boat is at rest.

BACKGROUND OF THE INVENTION

On boats today, it is desirable to secure anchors in a manner wherein the anchor is stored or held securely while a boat is underway, while allowing easy deployment of the anchor while the boat is at rest to secure the boat to the bed of the body of water such as a seabed or lake bed.

In order to accomplish this boats typically employ devices known as anchor rollers, often found mounted on a boat's top surface at the bow of the boat, for receiving an anchor therein which has a line attached to the anchor. The line may be secured to a cleat at the bow of the boat from where it leads to a windlass, which is typically used for raising and lowering the anchor.

Such anchor rollers are typically made of stainless steel with a bed which mounts on the bow section of the boat, partially extending from the bow of the boat over the water. Typically, (comma underlined) two sidewalls extend vertically from the bed along the length thereof, with typically at least one roller mounted to the sidewalls to allow the anchor roller to be easily rolled into the anchor roller above the bed between the sidewalls to be secured therein.

A problem with this arrangement is that the cleats used to tie off an anchor line, which is attached to the anchor, are often located to the side of the anchor roller, requiring the anchor line to be passed over the top edge of one of the sidewalls in contact therewith to be tied off at the cleat. The anchor line thus passes over a metal sidewall surface that, although typically smooth, can have rough areas resulting from manufacturing defects or the passage of time. Further, the edges of such a typical sidewall are not rounded, so that the anchor line must abruptly change direction when passing over the top of the sidewall, causing the anchor line to be pressed against a sharp corner as it contacts the top of the sidewall. In addition, the absence of restrictions on the anchor line's side to side movement as it slides in contact with the upper edge of the sidewall increases the likelihood that the anchor line will contact and rub against any rough areas that may be present in the contacted sidewall surface, in addition to rubbing against what is in effect a sharp or semi-sharp edge of the sidewall. Movement of the anchor line against the sidewall of a conventional anchor roller, both in an up-and-down direction as the anchor is paid out and pulled in and in a side-to-side direction as it slips due to lack of constraint, oftentimes leads to fraying of the anchor line, requiring replacement thereof.

An example of such an arrangement is shown by Figure I hereof showing an anchor line 13, passing over and in contact with a top edge 17 of a sidewall 15 to be tied at a cleat 53. As is evident, when anchor line 13 contacts the top edge 17 of the sidewall 15, that position necessarily forces the anchor line 13 to rub against the top edge 17 as the anchor line 13 is paid in and out. FIG. 1 also illustrates the absence of side-to-side constraints on movement of the anchor line 17 against the surface of the top edge 17. As may be appreciated, the sliding of the line 13 in contact with the top edge 17 of the sidewall 15 will lead to fraying of the line 13.

Accordingly, in accordance with the invention, there is provided an anchor roller which avoids the disadvantages of the prior anchor rollers, substantially reducing fraying and damage to an anchor line when in use.

SUMMARY OF THE INVENTION

In accordance with the invention, there is provided an anchor roller designed to be mounted on the bow of a boat for receiving an anchor securely therein while the boat is underway, and allowing the anchor to be easily deployed for anchoring the boat when stopped.

The anchor roller is made up of a bed extending a length sufficient to accommodate the anchor shank thereon with the flukes of the anchor extending outwardly therefrom. A pair of sidewalls extend upwardly from the bed along the length thereof, and define a housing for storing the anchor by receiving the shank of the anchor therein. At least one roller is supported by the sidewalls to support the anchor shank so the anchor can be easily moved in and out of the anchor roller.

The anchor includes a ring at the end of the shank opposite the flukes to which an anchor rode or line can be attached. The line can be tied to a cleat on a boat having the anchor roller, to securely hold the anchor within the anchor roller. In order to prevent the line from being frayed as a result of being passed over the top edge of the anchor walls sidewalls to be tied off, each sidewall has a cutout region smoothly finished and rounded at the edges defining an opening through which the line may be passed to be tied off, and avoid fraying the line as a result of sliding in contact with the upper edge of the sidewalls.

In another aspect, the invention is an improvement on an anchor roller of the type described. The improvement comprises the cutout with smooth, rounded edges in each of the sidewalls of the anchor roller. In a more specific aspect, (comma underlined) an insert having an opening is received and attached to the sidewall within the cutout. The edges of the opening in the insert are smooth.

In yet still another aspect, the invention includes the aforementioned anchor roller mounted on a boat with an anchor, cleat(s) and windlass to make up an anchor system.

BRIEF DESCRIPTION OF THE DRAWINGS

Having briefly discussed the invention, the same will become better understood from the following detailed discussion made with reference to the appended drawings, wherein.

DETAILED DISCUSSION OF EXEMPLARY EMBODIMENT

Having briefly discussed the invention, the following is a more detailed description of exemplary embodiments thereof.

Figure 1:
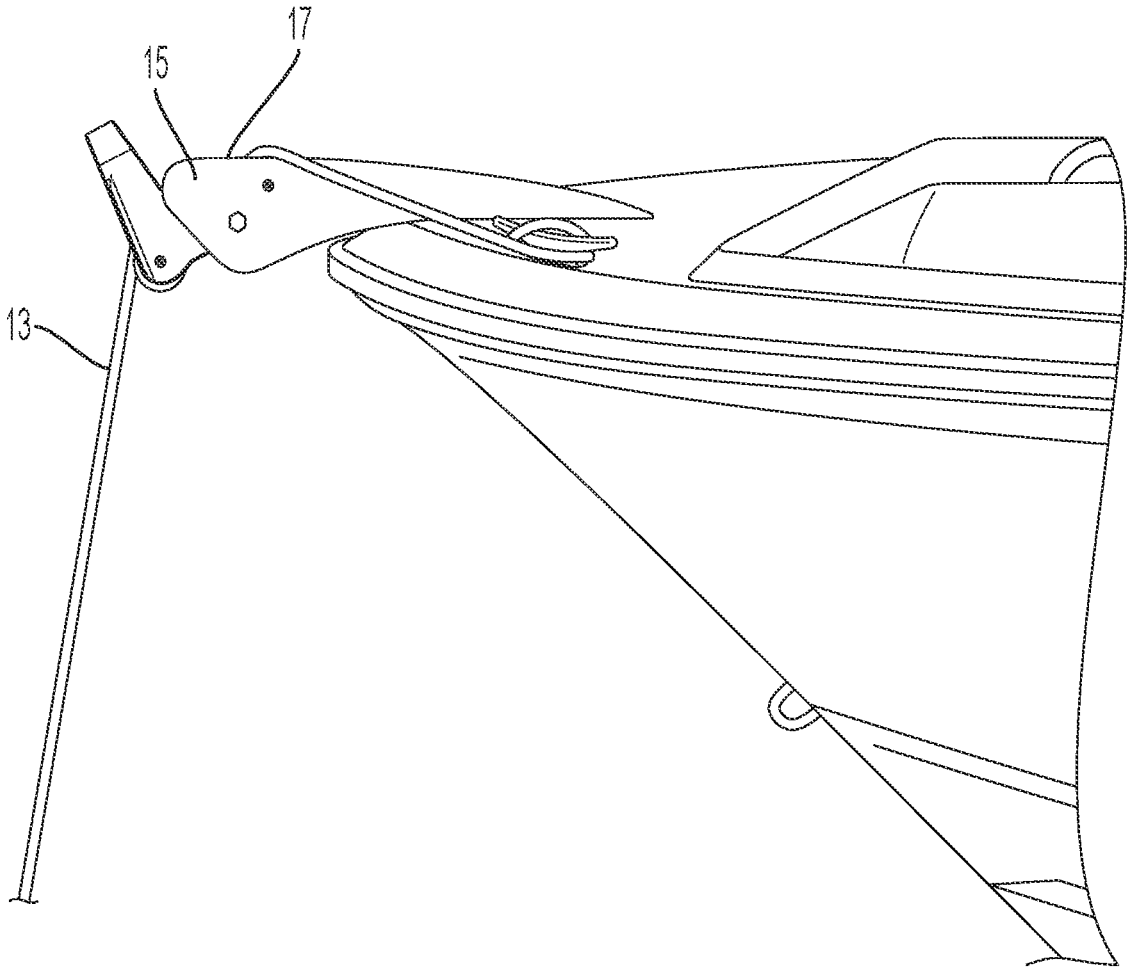
FIG. 1 PRIOR ART
FIG. 1 is a view of a prior art anchor roller with an anchor thereof deployed to anchor a boat.
Figure 2:
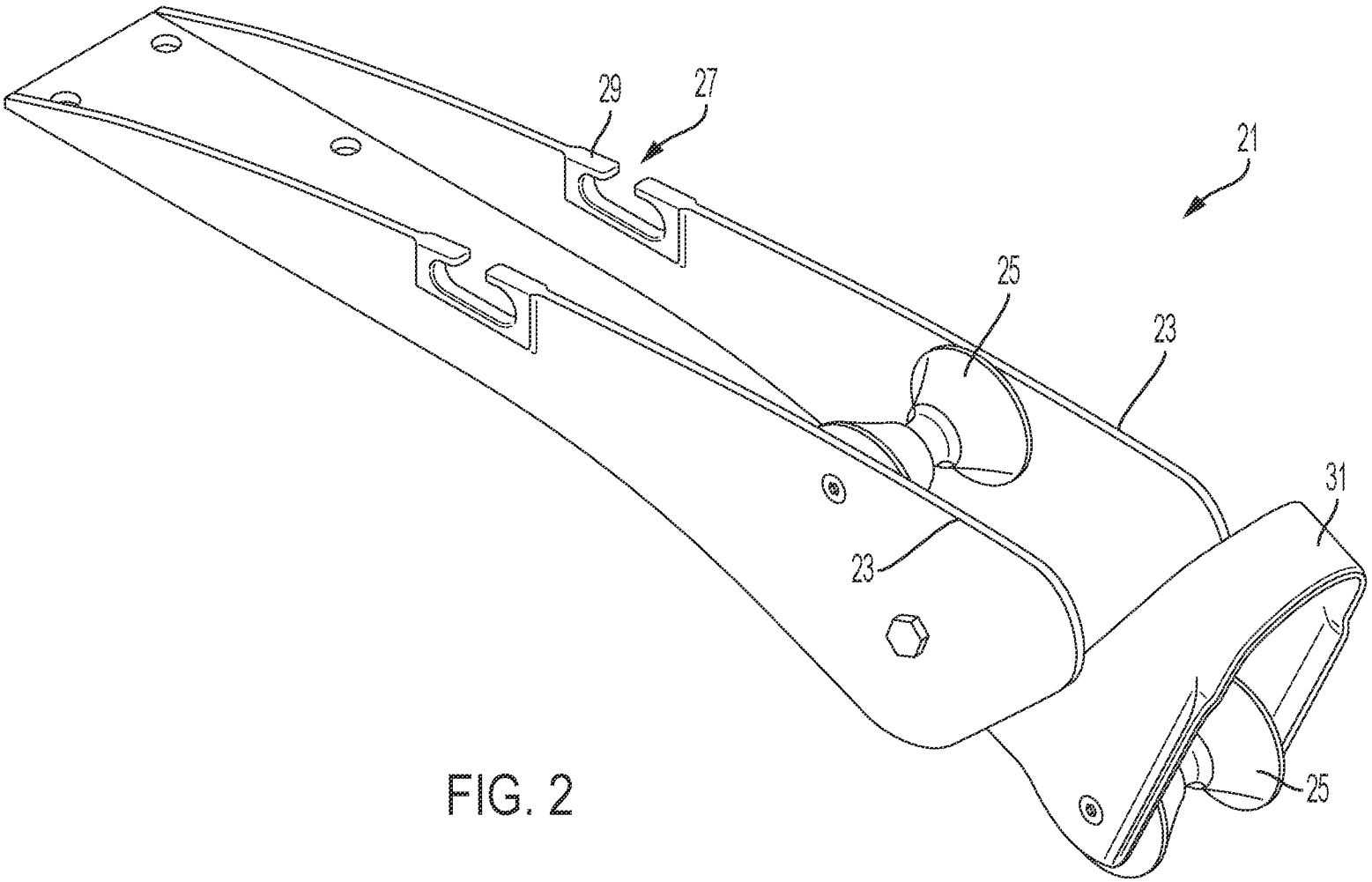
FIG. 2 is a front perspective view of an anchor roller according to the invention.

FIG. 2 is a view of one embodiment of the anchor roller 21 of the invention. The anchor roller 21 of the invention includes a bed 35 (numbered in FIG. 3) which is made preferably of stainless steel and sits on and is secured to a boat deck at the bow of a boat through screws passing through screw holes (not numbered). Vertically extending sidewalls 23 are connected to the bed 35 and extend the length of the bed 35. The sidewalls 23 are also preferably made of stainless steel and the bed 35 sidewalls 23 may be made as a single unit using conventional manufacturing techniques, or as three parts which may then be welded together.

As discussed hereafter, a pair of rollers 25 are provided to support an anchor shank 55 (add 55 underlined) as the anchor is moved into and out of the anchor roller 21. One roller is supported by the sidewalls 23. The other roller 25 is supported within a tiltable arch guide 31 which tilts forward as the anchor is being deployed to allow it to be guided into the water, and tilts back to assist in moving the anchor to a horizontal position as the anchor is brought into a nesting position in the anchor roller 21.

Figure 12:
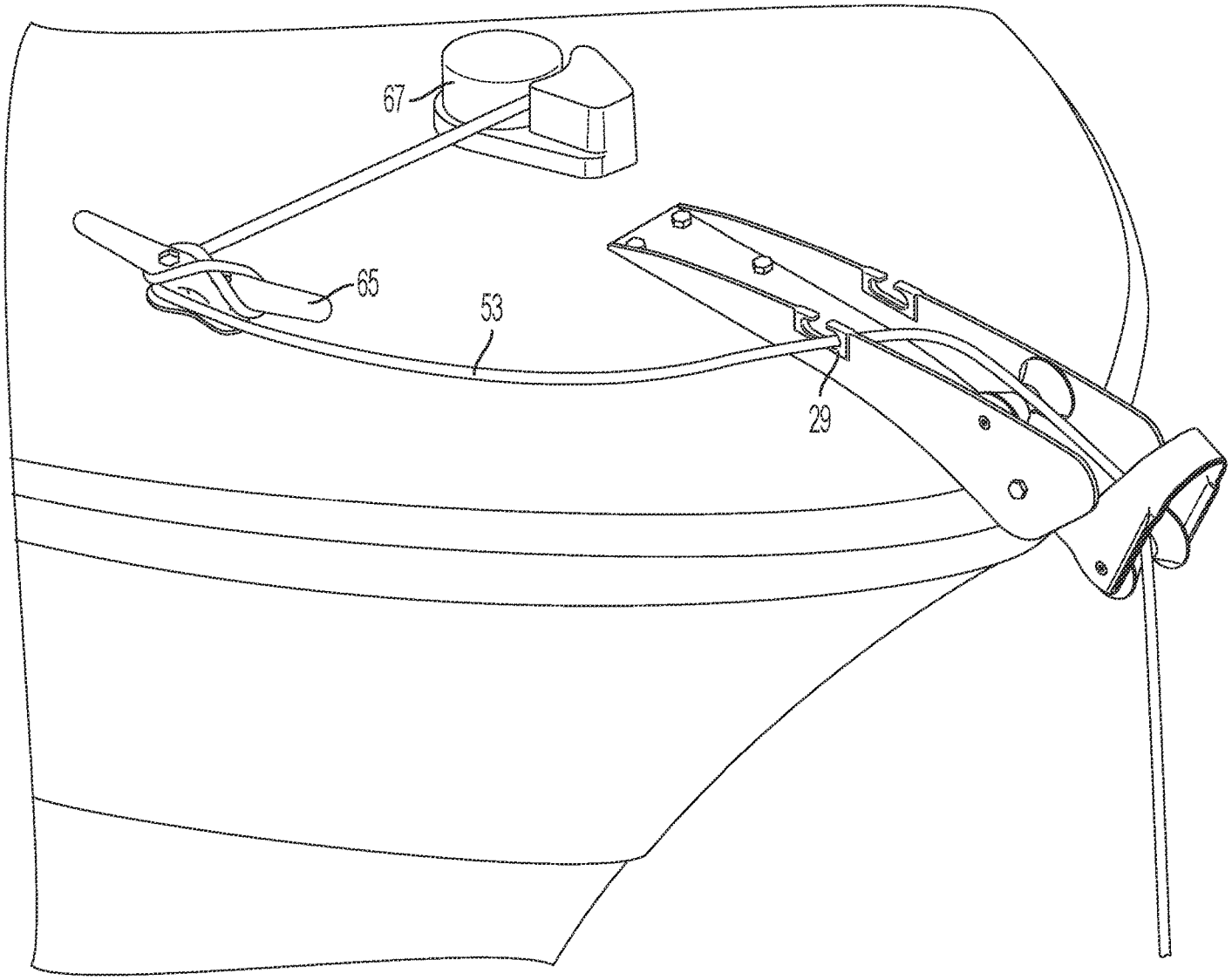
FIG. 12 is a front perspective view of the anchor roller mounted on the bow of a boat with anchor, cleat, with the anchor deployed and the anchor line tied to a cleat.

The anchor roller 21 also includes cutout regions 27, with inserts 29 secured within the cutout region 27 providing an opening through which an anchor rode or line can be passed to be tied to a cleat adjacent the anchor roller 21. The inserts 29 have an opening as shown, and edges of the insert defining the opening, are finished to be rounded and very smooth on the inside edge to allow the anchor line or rode to pass through in contact avoiding fraying or damaging the anchor line due to contact with the edge of the insert 29 defining the opening (FIG. 12). The insert 29 may be of stainless steel and welded within the cutout region 27. This avoids having to pass the line or rode over the upper edge of the sidewalls 23 exposing it to damage through contact with the upper edge of the sidewalls 23.

Figure 3:
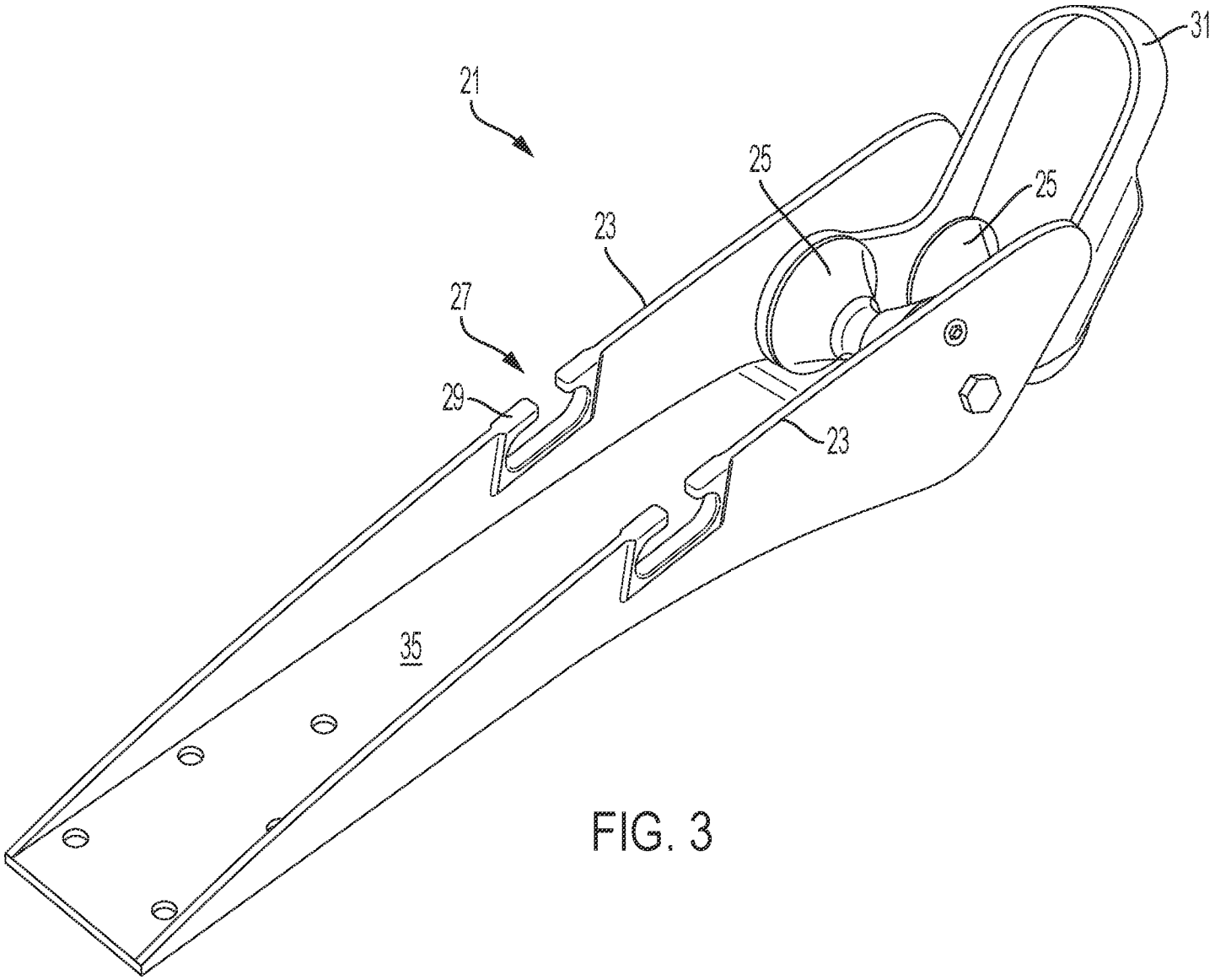
FIG. 3 is a back perspective view of an anchor roller according to the invention.

FIG. 3 is a view like FIG. 2 but from a rear perspective.

Figure 4:
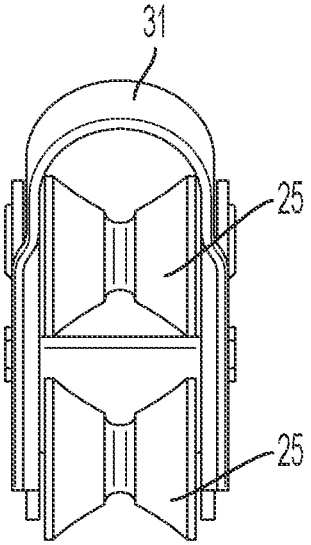
FIG. 4 is a front view of the anchor roller according to the invention.
Figure 5:
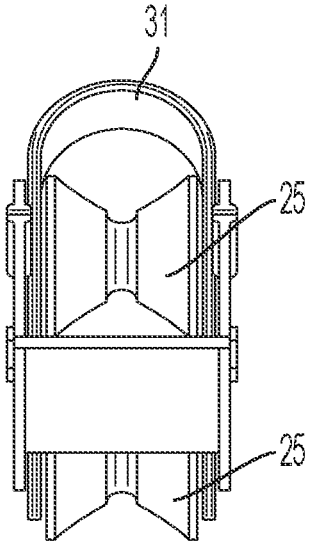
FIG. 5 is a back view of the anchor roller according to the invention.

FIGS. 4 and 5 are views of the anchor roller from the front and back respectively.

Figure 6:
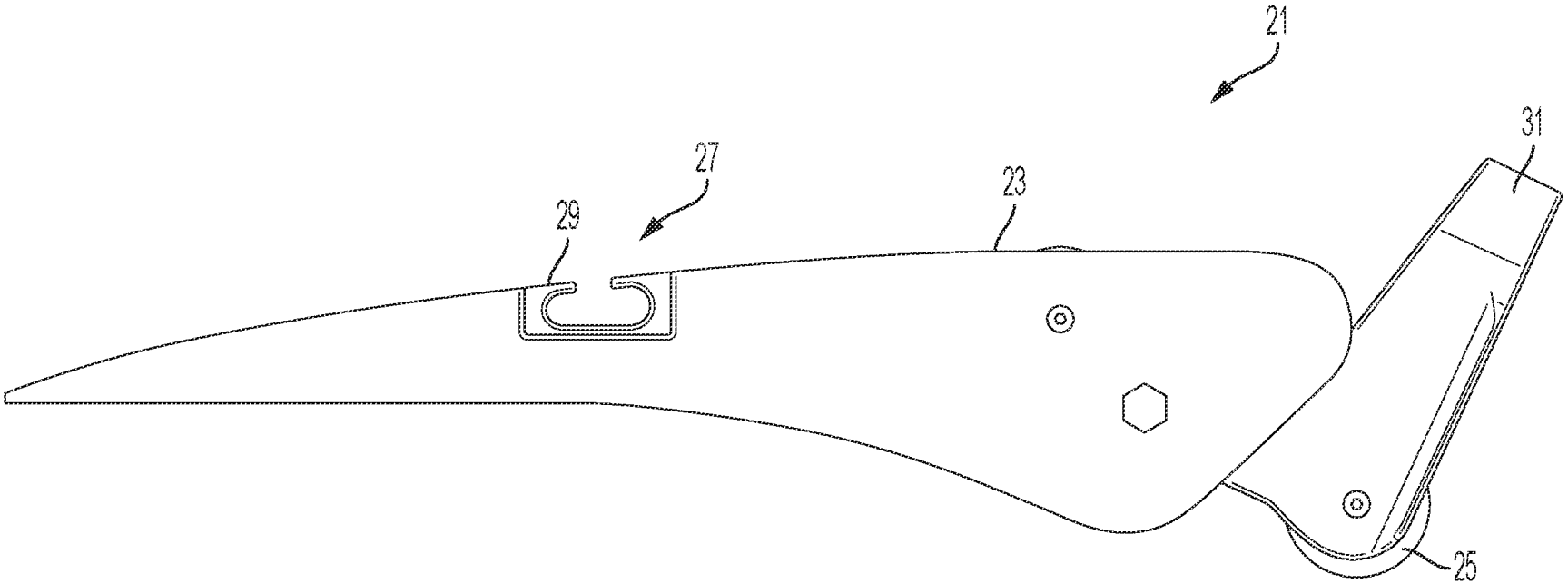
FIG. 6 is a left side view of the anchor roller according to the invention.
Figure 7:
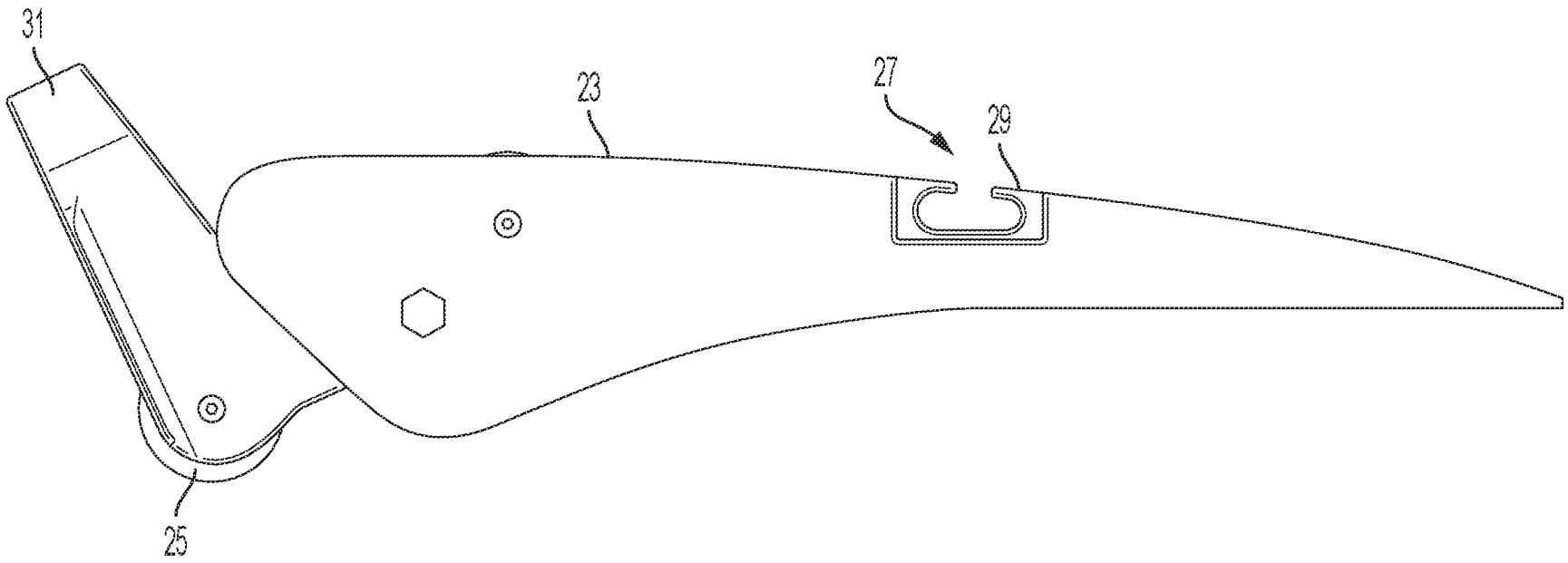
FIG. 7 is a right side view of the anchor roller according to the invention.

FIGS. 6 and 7 are side views from both sides.

Figure 8:
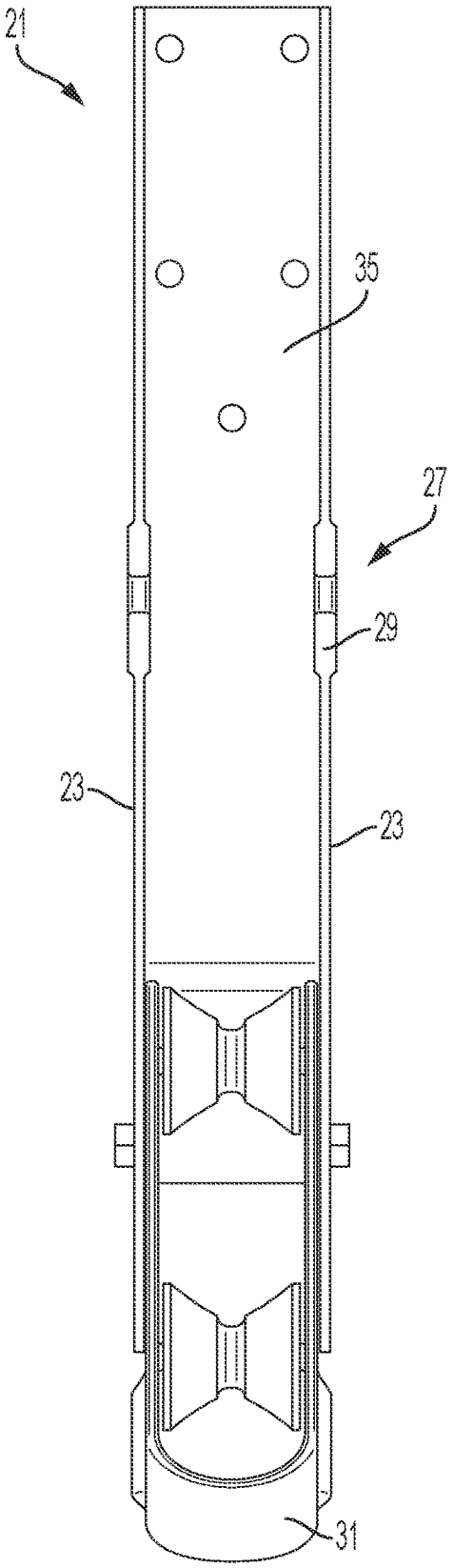
FIG. 8 is a top view of the anchor roller according to the invention.
Figure 9:
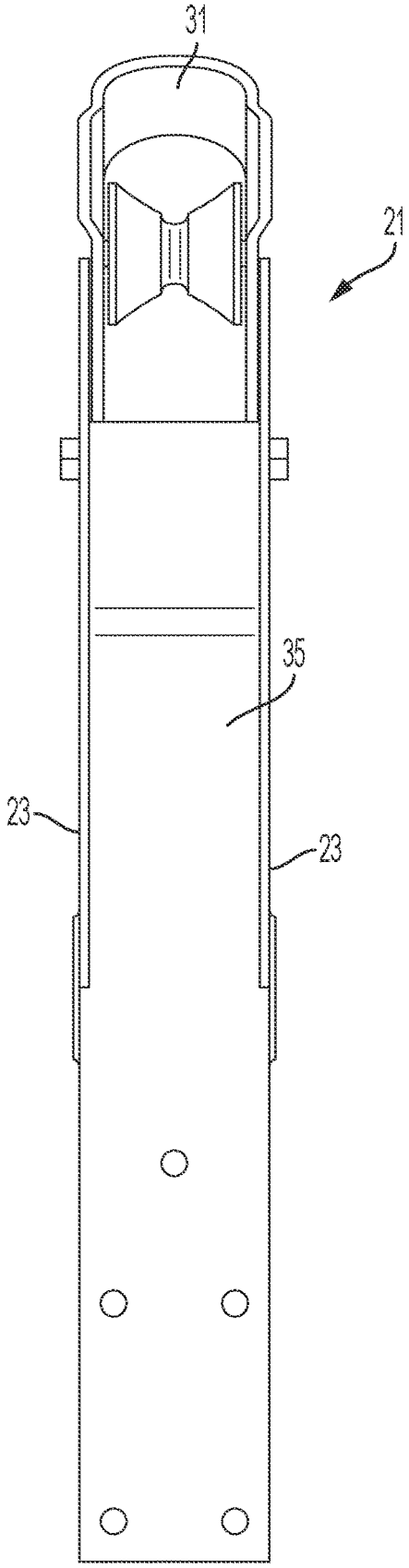
FIG. 9 is a bottom view of the anchor roller according to the invention.

FIG. 8 is a top view and FIG. 9 is a bottom view of the anchor roller 21.

Figure 10:
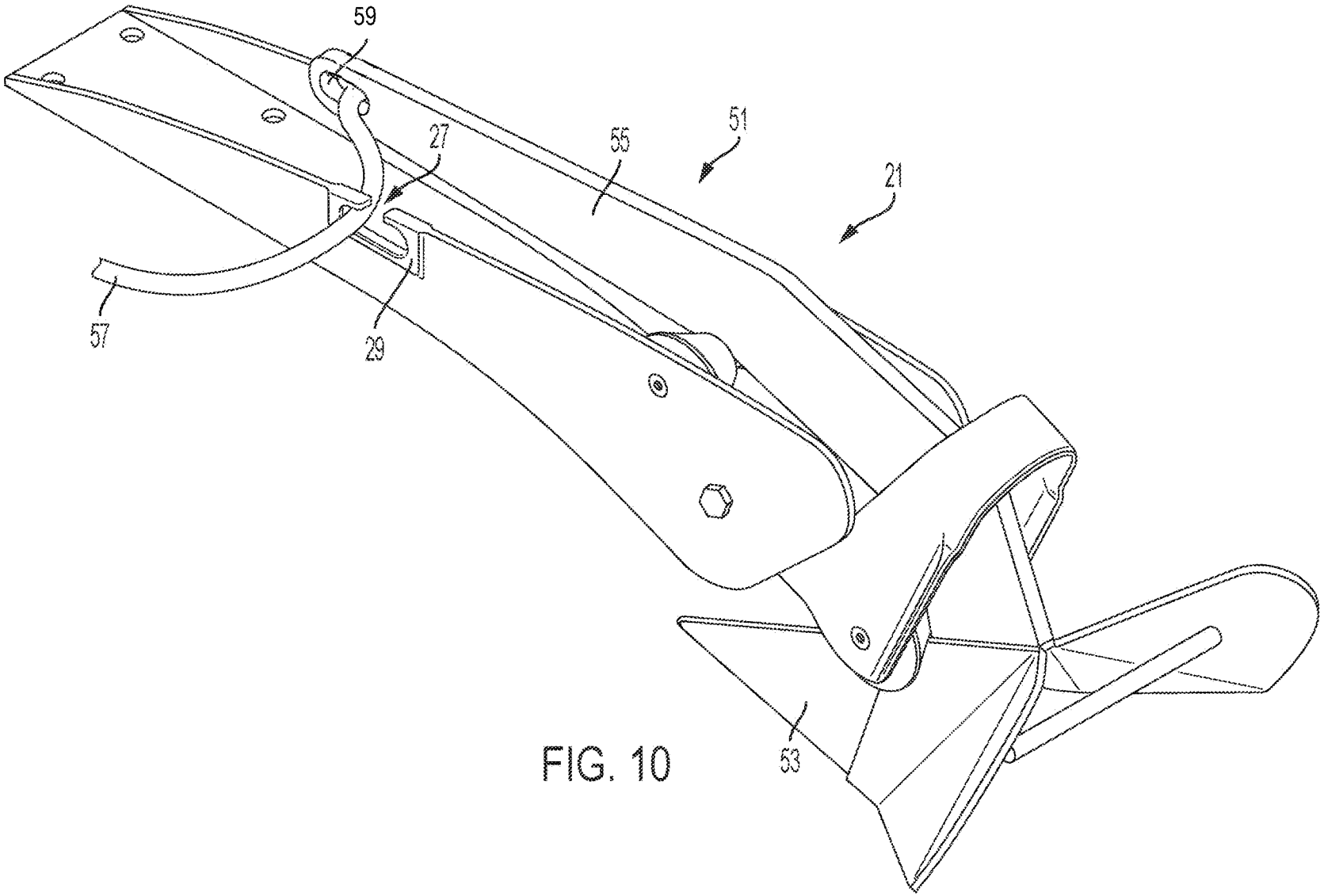
FIG. 10 is a front perspective view of the anchor roller with an anchor received therein.
Figure 11:
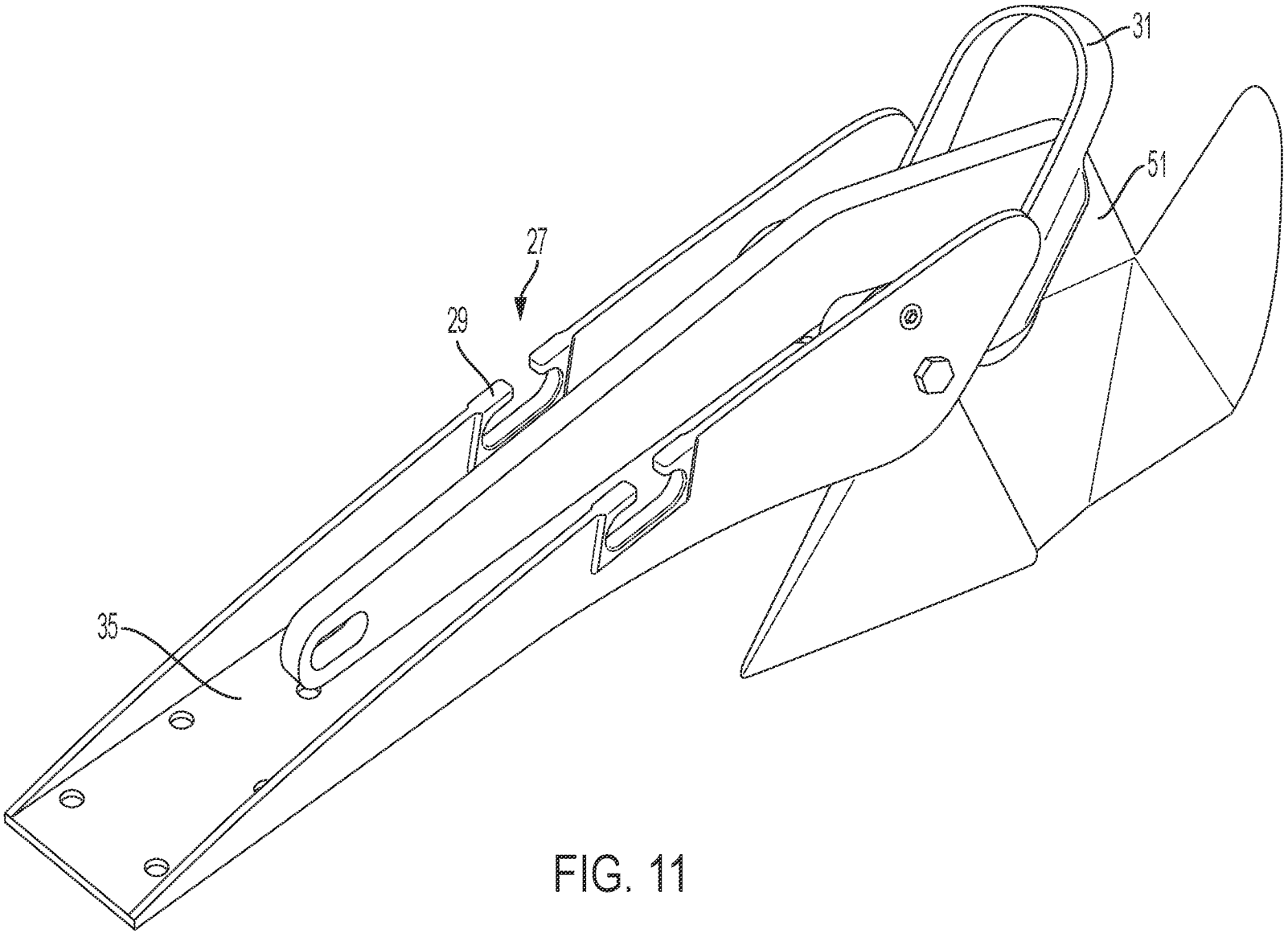
FIG. 11 is a back perspective view of the anchor roller with an anchor received therein.

FIGS. 10 and 11 are front and rear perspective views showing the anchor roller 21 with an anchor 51 nestled therein. Anchor flukes 53 project forward of the anchor with a shank 55 resting on a roller 25. A rode or anchor line 57 is secured to an anchor ring 59, and the anchor 51 held within the anchor roller 21 by the line 57 is tied off to a cleat 65, and from there, controlled by a windlass 67.

While the insert 29 is described as being of stainless steel, other materials such as carbon composites, fiberglass and the like may be used for the insert 29 to provide a smooth edge.

FIG. 12 shows the anchor roller 21 with the anchor deployed, and the line tied to a cleat to secure the anchor without damaging the anchor line.

Having described the invention, the same will be more clearly understood from the appended claims in which it is set forth in a non-limiting manner.

What is claimed is:

1. An anchor roller, comprising:

(a) a bed extending a length sufficient to accommodate an anchor shank thereof;

(b) a pair of sidewalls extending upwardly from the bed along the length thereof;

(c) at least one roller supported by the sidewalls for supporting an anchor shank so that an anchor can be easily moved in and out of the anchor roller; and (d) a cutout region in each sidewall having smooth edges to allow an anchor line to be passed therethrough without fraying from contact with the cutout edges.

2. The anchor roller of claim 1, further comprising an insert received in each cutout region and shaped to maintain an opening in the cutout region, with the edges of the insert being smooth an amount sufficient to avoid fraying an anchor line coming into contact with the edges thereof.

3. The anchor roller of claim 1, wherein the cutout region has an insert secured thereto, said insert shaped to have an opening coextensive with the cutout region and having smooth edges to avoid a line being frayed due to contact with the edges of the insert.

4. The anchor roller of claim 1, wherein the bed and sidewalls are made of stainless steel.

5. The anchor roller of claim 3, wherein the bed, the sidewalls and the inserts are made of stainless steel, and the inserts are welded to the sidewalls respectively at the cutout region.

6. In an anchor roller of the type having a bed and a pair of sidewalls extending vertically along the length of the bed, the improvement consisting substantially of:

a cutout region respectively in each sidewall, the cutout region having smooth edges to allow a line to pass through the opening defined by edges of the cutout, said edges being smooth to avoid fraying a line coming into contact therewith.

7. The anchor roller of claim 6, further comprising an insert received in each cutout region and shaped to maintain an opening in the cutout region, with the edges of the insert being smooth an amount sufficient to avoid fraying an anchor line coming into contact with the edges thereof.

8. The anchor roller of claim 6, wherein the bed and sidewalls are made of stainless steel.

9. The anchor roller of claim 6, wherein the bed, the sidewalls and the inserts are made of stainless steel, and the inserts are welded to the sidewalls respectively at the cutout region.

* * * * *